US005151246A

United States Patent [19]

Baumeister et al.

[11] Patent Number: 5,151,246

[45] Date of Patent: Sep. 29, 1992

[54] METHODS FOR MANUFACTURING FOAMABLE METAL BODIES

[75] Inventors: Joachim Baumeister, Bremen; Hartmut Schrader, Schwanewede, both of Fed. Rep. of Germany

[73] Assignee: Fraunhofer-Gesellschaft zur Forderung der Angewandten Forschung e.V., Munich, Fed. Rep. of Germany

[21] Appl. No.: 708,350

[22] Filed: May 31, 1991

[30] Foreign Application Priority Data

Jun. 8, 1990 [DE] Fed. Rep. of Germany ..... 4018360
Jan. 21, 1991 [DE] Fed. Rep. of Germany ..... 4101630

[51] Int. Cl.[5] ..... B22F 1/00

[52] U.S. Cl. ..... 419/2; 419/37; 419/46; 419/50; 264/44; 264/54

[58] Field of Search ..... 419/2, 48, 50, 37; 264/44, 54

[56] References Cited

U.S. PATENT DOCUMENTS 3,087,807 4/1963 Allen et al. ..... 75/20
3,848,666 11/1974 Valdo ..... 164/98
3,929,425 12/1975 Valdo ..... 428/613
3,940,262 2/1976 Niebylski et al. ..... 75/415
3,941,182 3/1976 Bjorksten et al. ..... 75/415
4,973,358 11/1990 Jin et al. ..... 75/415

FOREIGN PATENT DOCUMENTS 939612 10/1963 United Kingdom .

*Primary Examiner*—Stephen J. Lechert, Jr.
*Attorney, Agent, or Firm*—Weingarten, Schurgin, Gagnebin & Hayes

[57] ABSTRACT

A method is described for manufacturing foamable metal bodies in which a mixture (17) of a metal powder (15) and a gas-splitting propellent powder (16) is hot-compacted to a semifinished product (19) at a temperature at which the joining of the metal powder particles takes place primarily by diffusion and at a pressure which is sufficiently high to hinder the decomposition of the propellent in such fashion that the metal particles form a solid bond with one another and constitute a gas-tight seal for the gas particles of the propellant. The foamable metal body can also be produced by rolling. In addition, a use of the foamable metal body (19) thus produced for manufacturing a porous metal body (21) is proposed.

22 Claims, 3 Drawing Sheets

METHODS FOR MANUFACTURING FOAMABLE METAL BODIES

FIELD OF THE INVENTION

The invention relates to methods of manufacturing foamable metal bodies and their use.

BACKGROUND OF THE INVENTION

U.S. Pat. No. 3,087,807 teaches a method which permits the manufacture of a porous metal body of any desired shape. According to this method, a mixture of a metal powder and a propellant powder is cold-compacted at a compressive pressure of at least 80 MPa in a first step. Subsequent extrusion molding reshapes it at least 87.5%. This high degree of conversion is necessary for the friction of the particles with one another during the shaping process to destroy the oxide coatings and bond the metal particles together. The extruded rod thus produced can be foamed to form a porous metal body by heating it at least to the melting point of the metal. Foaming can be performed in various molds so that the finished porous metal body has the desired shape. The disadvantage is that this method is costly because of its two-step compacting process and the very high degree of conversion required, and is limited to semifinished products that can be made in extrusion molds. The method disclosed in this U.S. patent can only use propellants whose decomposition temperature is above the compacting temperature, since otherwise the gas would escape during the heating process. However, propellants whose decomposition temperatures are below the compacting temperature are suitable for many types of metals and are economical. During the foaming which follows the compacting process, a porous metal body is produced with open porosity, i.e., the pores are open or connected together. The extrusion process according to the method described in the U.S. patent is necessary because bonding of the metal particles takes place as a result of the high temperatures that occur during the extrusion process and the friction of the particles against one another, in other words, by welding the particles together. Since for the reasons given above the temperature required for bonding the particles together cannot be set at an arbitrary level, very high degrees of conversion must be used to produce a bonding of the metal particles with one another which is as satisfactory and gas-tight as possible.

In addition, several methods are known in which porous metal materials can be produced. One simple method for producing these materials is mixing substances that split off gases into metal melts. Under the influence of temperature, the propellant decomposes, releasing gas. This process results in the foaming of the metal melt. When the process is complete, a foamed metal material is left which has an irregular random shape. This material can be processed further by suitable methods to produce bodies of desired shape. It is important to keep in mind, however, that only separating methods can be used as methods for further processing, and consequently not just any metal body can be shaped from such a metal material. This is disadvantageous. Other methods for producing porous metal materials suffer from similar disadvantages, including, for example, impregnating an existing plastic foam with a slurry of metal powder and a carrier medium and then burning off or evaporating the plastic foam after drying.

Apart from the above-mentioned disadvantages, this method is very costly.

SUMMARY OF THE INVENTION

The goal of the present invention is to provide a method for manufacturing foamable metal bodies which is economical, simple to use, can be worked without high conversion engineering costs, and can be used simultaneously for propellants with low decomposition temperatures. Another goal of the invention is to propose an application for foamable bodies thus produced.

Accordingly, a mixture of one or more metal powders and one or more propellant powders which can split gases is prepared initially. The following can be used as propellants: metal hydrides, for example titanium hydride; carbonates, for example calcium carbonate, potassium carbonate, sodium carbonate, and sodium bicarbonate; hydrates, for example aluminum sulphate hydrate, alum, and aluminum hydroxide; or substances that evaporate readily, for example mercury compounds or pulverized organic substances. This intensively and thoroughly mixed powder mixture is compressed by hot pressing or hot isostatic pressing to form a compact gas-tight body. During the compacting process it is of critical importance to the invention that the temperature be high enough so that the bond between the individual metal powder particles is produced primarily by diffusion. It is also important to select a pressure that is sufficiently high to prevent decomposition of the propellant, so that a compacted body is produced in which the metal particles are in a fixed relationship to one another and form a gas-tight seal for the gas particles of the propellant. The propellant particles are therefore "enclosed" between the metal particles bonded together so that they release gas only in a later step in the foaming process. Hence, propellants can be used whose decomposition temperatures are below the compacting temperature. This use of high pressure does not cause these propellants to decompose. This measure according to the invention permits the use of propellants that can be selected only from the viewpoint of compatibility with the selected metal powder or from the viewpoint of economy of the method. A suitable choice of the method parameters, temperature and pressure, ensures that a body is produced which has a gas-tight structure. In addition, the fact that the propellant gas remains "enclosed" between the metal particles prevents it from escaping prematurely from the compacted body. Hence, the amounts of propellant required are small. Thus, propellant quantities on the order of several tenths of a percent by weight are sufficient because the compacted body is completely compressed and the propellant gas cannot escape. Propellant quantities of 0.2 to 1% have proven to be especially advantageous. Only the amount of propellant need be added which is necessary to produce a foam structure. This results in a cost saving. It is also advantageous that because of the selected high temperature and the use of high pressure, the compacting process occurs in a short period of time.

One advantageous feature of the method according to the invention is that after the hot compacting process is completed, both the action of heat and the action of pressure can be eliminated simultaneously. The still-hot metal body retains its shape although it is no longer subjected to the action of pressure. This means that the metal particles form such a tight seal for the propellant powder particles that no expansion of the propellant occurs even at high temperatures. The metal body thus formed is dimensionally stable and retains its shape even at high temperatures and without the action of pressure.

To increase the strength of the metal bodies, the invention provides for the addition of reinforcing components in the form of fibers or particles of suitable material such as ceramic or the like. These are advantageously mixed with the starting powders. For this purpose, the starting materials and the foaming parameters in particular must be chosen such that good cross linking of the reinforcing components by the metal matrix is ensured. It is advantageous for the fibers or particles to be coated (with nickel for example). This ensures that the forces will be conducted from the metal matrix into the particles or fibers.

Another method for manufacturing foamable metal bodies is rolling, at high temperature, a powder mixture consisting of at least one metal powder and at least one propellant powder. This produces a bonding of the metal and propellant powder particles in the roller nip. For the individual skilled in the art, this has the surprising result that diffusion between the particles takes place at low temperatures, in the range of about 400° C. for aluminum, to a sufficient degree. These processes occur especially in the surface layers. The temperature range between 350° C. and 400° C. has been found to be especially advantageous for aluminum rollers. In particular, the measure of intermediate heating of the prerolled material following the individual roll passes has been found to be significant since the creation of edge cracks can be largely avoided as a result.

According to one embodiment, the method according to the invention provides for alignment of the reinforcement along a preferred direction if this can be accomplished by conversion of the foamable body. This conversion can be produced for example by extrusion presses or rollers.

In one advantageous embodiment, the invention provides that two or more propellants with different decomposition temperatures be mixed into the metal powder. When a foamable body made from this powder mixture is heated, the propellant with the lower temperature decomposes first, causing foaming. If the temperature is increased further, the propellant with the next higher decomposition temperature decomposes, causing further foaming. Foaming takes place in two or more steps. Metal bodies which can be foamed in stages as they expand have special applications, for example in fireproofing.

One special advantage of the method according to the invention consists in the fact that it is now possible to make bodies that have densities that change continuously or discontinuously over their cross sections, or so-called graduated materials. In this connection, an increase in density toward the edge of the foamable body is preferred, since this is where the primary stress occurs. In addition, a foamable body with a solid cover layer or a cover layer of higher density offers advantages as far as interlocking and connecting with similar or different materials is concerned. If the hot-compacting process is performed in a mold, with the powder mixture surrounded completely or partially by a propellant-free metal or metal powder, the propellant-free metal layers form a solid, less porous outer layer or bottom layer or cover layer, between which a layer is located which forms a highly porous metal foam layer after a foaming process. By producing the foamable metal body in such a way that a propellant-free metal piece is placed in front of the powder mixture and the powder mixture is then extrusion-molded, a foamable body is produced which is compressed together with the solid material, and the solid material surrounds the foamable body in the form of an outer layer.

The foamable metal body produced by the method according to the invention can be used to produce a porous metal body. This is accomplished by heating the foamable body to a temperature above the decomposition temperature of the propellant, whereupon the latter releases gas, and then cooling the body thus foamed. It is advantageous for the heating temperature to be in or above the temperature range of the melting point of the metal used or in the solidus-liquidus interval of the alloy used.

The heating rates of the semifinished product during the foaming process are within normal limits, in other words they are about 1° to 5° C. per second. High heating rates are not necessary since the gas cannot escape anyway. These usual heating rates are another feature of the invention that helps to lower cost. Of course, a high heating rate is advantageous in individual cases, for example to achieve small pore size.

The method according to the invention also provides that after foaming, a cooling rate must be selected such that no further foaming action takes place that starts in the interior of the body and proceeds outward. Therefore, the cooling rate for large parts must be higher than for smaller ones; it must be adjusted to the volume of the sample.

Another advantageous embodiment of the present invention provides for a suitable choice of the foaming parameters, time and temperature, used to vary the density of the porous metal body. If the foaming process is interrupted after a certain time at a constant temperature, a certain density will be obtained. If the foaming process is continued longer, different density values will result. It is important that certain limits be observed: a maximum admissible foaming time must be observed which, if exceeded, will cause the already foamed material to collapse.

Foaming of the semifinished product takes place freely if no final shape is specified. Foaming can also take place in a mold. In this case the finished porous metal body takes on the desired shape. Therefore it is possible to use the method according to the invention to produce molded bodies from porous metal material.

The metal body formed by foaming the resultant semifinished product has predominantly closed porosity; such metal bodies float in water. The resultant pores are uniformly distributed throughout the entire metal body, and they also have approximately the same size. The pore size can be adjusted during the foaming process by varying the time during which the metal foam can expand. The density of the porous metal body can be adjusted to suit requirements. This can be accomplished not only by suitable selection of the foaming parameters as already described but also by suitable addition of propellant. The strength and ductility of the porous metal body can be varied by choosing the parameters temperature and time under which the foaming takes place. These two properties are modified in any event by adjusting the desired pore size. Of course the properties of the finished metal body depend primarily on the choice of the starting materials.

The moldability of the compacted semifinished product is comparable to that of the solid starting metal. The semifinished product does not differ from the starting metal, even in external appearance. The semifinished product therefore can be processed by suitable shaping methods to produce semifinished products of any desired geometry. It can be shaped into sheets, sections, etc. It lends itself to nearly any shaping method which occurs with the decomposition temperature in mind. It is only when the semifinished product is heated during the shaping process to temperatures above the decomposition temperature of the propellant used, that foaming occurs.

If a body produced according to one embodiment of the invention is used to produce a porous metal body, a less porous outer layer surrounds a core of highly porous foamed metal after foaming. Another use of the foamable body is to produce metal foams with solid outer layers. The foamable body is then initially shaped into a cylindrical rod by suitable shaping methods; this rod is inserted into a cylindrical tube and then foamed. This method can also be applied to other hollow shapes and molded parts. It is also possible to make an integrally foamed body by restricting the expansion of the foamable body by solid walls. As soon as the surface of an initially freely expanding foam contacts the walls, the pores near the surface are flattened by the internal pressure of the material which continues to foam from the interior so that the initially highly porous outer edge of the molded part is compressed once more. The thickness of this outer edge, which has a density higher than that of the interior of the workpiece, can be controlled by means of the period of time during which, after contact with the walls, the material is allowed to continue foaming from inside before the molded part is finally cooled, causing the subsequent foaming to stop. Finally, methods are possible in which the surface of the body which is foamable according to the invention or the surface of the expanding foam can be kept from foaming as much as in the noncooled areas, by cooling it. Cooling can then be accomplished by suitable cooling media or by contact with cold materials. Cooling can act upon the entire surface or only on partial areas.

Integral foam-type metal bodies can be produced by gluing a metal foam to similar or different materials. In addition to gluing, other joining and fastening methods may be used (soldering, welding, or screwing). Finally, a metal foam can also be potted in metal melts or other initially liquid and then rigid or hardening materials.

In the following examples, the pattern of the method according to the invention and a use of the foamable body produced by the method according to the invention will be discussed:

Example 1

A powder mixture with a composition $AlMg_1$ containing 0.2 wt. % titanium hydride was loaded into a hot extrusion device and heated at a pressure of 60 MPa to a temperature of 500° C. After a holding time of thirty minutes, the sample was released, removed, and cooled. Foaming took place by heating the sample in a laboratory furnace preheated to 800° C. The density of the resultant aluminum foam was approximately 0.55 g/cm$^3$.

Example 2

A powder mixture with the composition $AlMg_2$ containing 0.2 wt. % titanium hydride was compacted in the hot molding device at a pressure of 100 MPa and a temperature of 550° C., and was released and removed after a holding time of 20 minutes. Subsequent foaming of the sample took place by heating the sample in a laboratory furnace preheated to 800° C. and produced a foam with a density of 0.6 g/cm$^3$.

Example 3

A powder mixture consisting of pure aluminum powder and 1.5 wt. % sodium bicarbonate ($NaHCO_3$) was loaded into a hot molding device and heated at a pressure of 150 MPa to a temperature of 500° C. After a holding time of 20 minutes, the sample was removed and foamed in a furnace preheated to 850° C. The density of the resultant aluminum foam was 1.3 g/cm$^3$.

Example 4

A powder mixture composed of pure aluminum powder and 2 wt. % aluminum hydroxide was loaded into the hot molding device and heated at a pressure of 150 MPa to a temperature of 500° C. After a holding time of 25 minutes, the sample was removed and foamed in a furnace preheated to 850° C. The density of the resultant aluminum foam was 0.8 g/cm$^3$.

Example 5

A bronze powder with the composition 60% Cu and 40% Sn was mixed with 1 wt. % titanium hydride powder and this powder mixture was compacted at a temperature of 500° C. and a pressure of 100 MPa for 30 minutes. Then the compacted sample was heated in a furnace preheated to 800° C. and foamed. The resultant bronze foam had a density of approximately 1.4 g/cm$^3$.

Example 6

A mixture of 70 wt. % copper powder and 30 wt. % aluminum powder was mixed with 1 wt. % titanium hydride, and this powder mixture was then compacted at a temperature of 500° C. and a pressure of 100 MPa for 20 minutes. Then the compacted sample was heated in a furnace preheated to 950° C. and foamed. The density of this foamed copper alloy was less than 1 g/cm$^3$.

Further experiments to produce nickel foam have already led to the first usable results.

Example 7

A powder mixture of aluminum powder and 0.4 wt. % titanium hydride powder was heated to a temperature of 350° C. Then this heated powder mixture was fed to a roller nip and shaped in 3 passes. The result was a sheet which was cooled in quiet air. Sections measuring 100 meters × 100 millimeters were cut from this sheet, with the crack-prone edge areas being removed. These segments were foamed freely in a furnace preheated to 850° C. and yielded density values of approximately 0.8 g/cm$^3$. In a modification of the method, intermediate heating for 15 minutes at 400° C. was performed after the first pass. The intermediate heating was able to reduce the occurrence of edge cracks considerably.

DESCRIPTION OF THE DRAWINGS

One embodiment of the method according to the invention is shown in FIGS. 1 and 2.

DETAILED DESCRIPTION OF THE INVENTION

Figure 1:
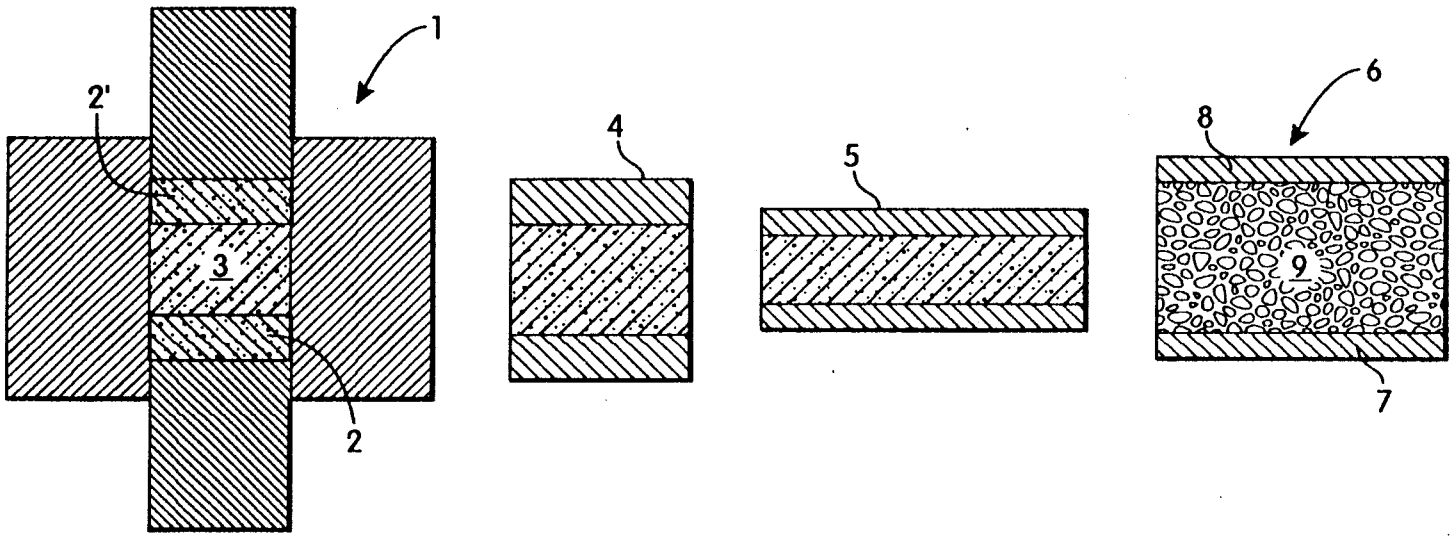
FIG. 1 shows the production of a foamable integrated metal body in a mold.

As FIG. 1 shows, a layer 2 of propellant-free metal powder is placed in a hot molding device 1, after which a layer of propellant-containing metal powder 3 is added and finally another layer 2' of propellant-free metal powder. After the compacting method according to the invention has been performed, a blank 4 is obtained which may be further shaped into another body 5. This body can then be foamed to form yet another body 6. The propellant-free metal layers each form a solid, less porous bottom layer 7 or cover layer 8 between which a highly porous metal foam layer 9 is located.

Figure 2:
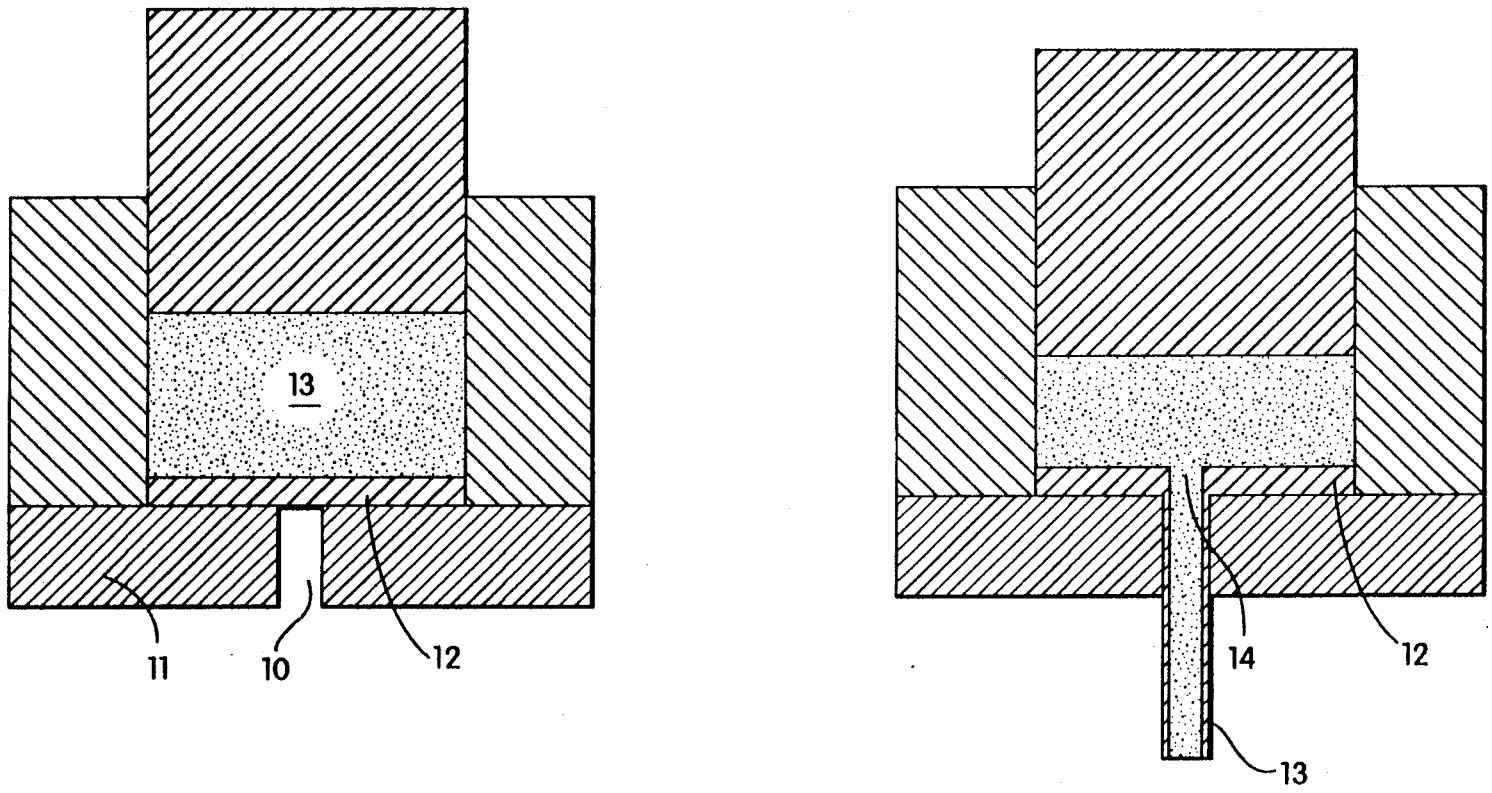
FIG. 2 shows the method for manufacturing a foamable integrated metal body by extrusion molding.

Another method for producing integral foams is shown in FIG. 2. In this case opening 19 of an extrusion-molding tool is initially covered by a disk of solid metal 12. Then the molding chamber of the tool is filled with propellant-containing powder 13 and the powder mixture is subjected to a pressure of about 60 MPa. By heating the tool together with powder mixture 13, the latter is compressed. Then the compression pressure is set such that the central area of solid metal plate 12 which blocks opening 10 of the tool flows through this opening !0 and thus exposes it. During subsequent stages of the compression process the foamable semifinished product 14 together with solid material 12 is forced through opening 10, whereby solid material 12 surrounds the foamable body in the form of an outer layer 13. After the foaming of this combined body, a less porous layer surrounds a core made of highly porous foamed metal.

Figure 3:
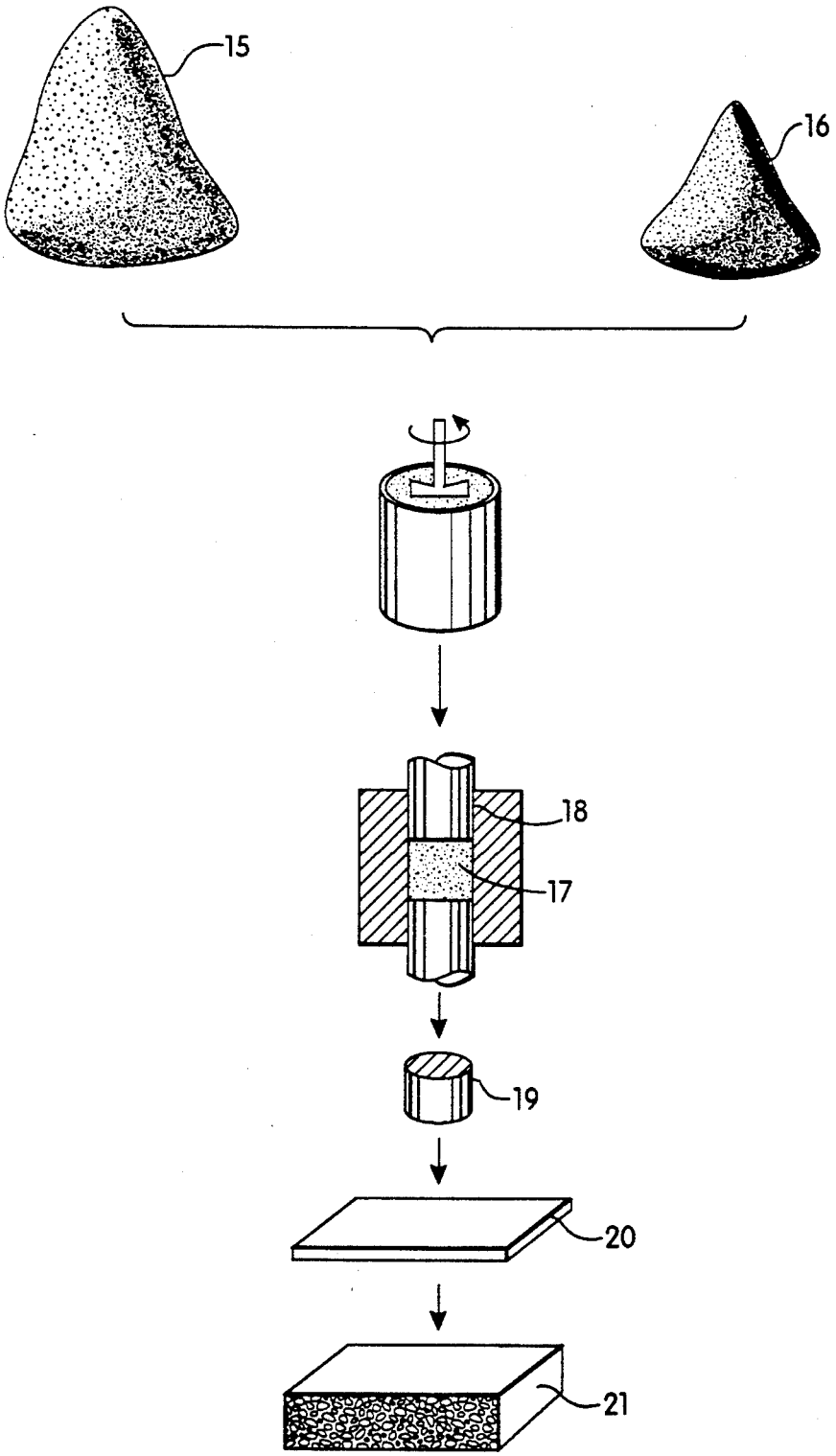
FIG. 3 is a schematic diagram of the method according to the invention and its use.

FIG. 3 is a schematic diagram of the method according to the invention and one application: a metal powder 15 is intensively mixed with a propellant powder 16. Resultant mixture 17 is compacted in a press 18 under pressure and temperature. After compacting the result is a semifinished product 19. Semifinished product 19 can be shaped for example into a sheet 20. Then sheet 20 can be foamed under the influence of temperature to produce a finished porous metal body 21.

We claim:

1. A method for producing foamable metal bodies in which a mixture composed of at least one metal powder and at least one gas-splitting propellant powder is produced and hot-compacted to a semifinished product, comprising hot-compacting the mixture at a temperature at which the joining of the metal powder particles takes place primarily through diffusion and at a pressure which is sufficiently high to hinder the decomposition of the propellant in such fashion that the metal particles are permanently bonded to one another and form a gas-tight seal for the gas particles of the propellant.

2. The method according to claim 1 wherein the temperature during hot-compacting is above the decomposition temperature of the propellant.

3. The method according to claim 1 wherein the action of heat and the action of pressure are simultaneously suspended at the end of the hot-compacting process and the complete cooling of the metal body takes place without the influence of pressure.

4. The method according to claim 1 wherein the powder mixture has added to it high-strength reinforcing components.

5. The method according to claim 4 wherein the hot-compacting step is followed by aligning the reinforcing components in a preferential direction.

6. A method for producing foamable metal bodies in which a mixture of at least one metal powder and at least one gas-splitting propellant powder is prepared, comprising rolling the mixture at high temperature and at a pressure which is sufficiently high to hinder the decomposition of the propellant in such fashion that the metal particles are in a permanent bond to one another and form a gas-tight seal for the gas particles of the propellant.

7. The method according to claim 6 wherein the rolling temperature is 350° C.–400° C. for the materials aluminum and titanium hydride.

8. The method according to claim 7 wherein the pre-rolled semifinished product is heated intermediately after individual rolling passes.

9. The method according to claim 6 wherein the temperature of the intermediate heating is 400° C. and the time is 15 minutes.

10. The method according to claim 6 wherein at least two different propellant powders with different decomposition temperatures are used.

11. The method according to claim 1 wherein the hot-compacting takes place in a mold such that the powder mixture is completely or partially surrounded by a propellant-free metal or metal powder.

12. The method according to claim 1 wherein the hot-compacting is accomplished by extrusion molding, with the powder mixture being piled against a propellant-free metal piece.

13. The method according to claim 1 wherein a porous metal body is made by heating the metal body to a temperature above the decomposition temperature of the propellant, followed by cooling of the body thus foamed.

14. The method according to claim 1 wherein a porous metal body is made by heating the metal body to a temperature above the decomposition temperature of the propellant in the temperature range of the melting point of the metal used or in the solidus-liquidus interval of the alloy used, followed by cooling of the body thus foamed.

15. The method according to claim 1 wherein a porous metal body is made by heating the metal body to a temperature above the decomposition temperature of the propellant, whereby during foaming of the metal body, different temperature and time values are used as a function of the density of the metal body to be produced, followed by cooling of the body thus foamed.

16. The method according to claim 1 wherein a porous metal body is made by heating the metal body to a temperature above the decomposition temperature of the propellant, with the heating rate being between 1° and 5° C./sec, followed by cooling of the body thus foamed at a rate which is so high relative to the volume of the foamed body that further foaming is interrupted.

17. A method of producing a foamable metal body, comprising:

mixing a metal powder and a gas-splitting propellant powder to form a mixture; and compacting the mixture at a temperature at which the joining of particles of the metal powder takes place primarily through diffusion and at a pressure which is sufficiently high to hinder the decomposition of the propellant such that the metal particles are permanently bonded to one another and form a gas-tight seal for the gas particles of the propellant.

18. A method of producing a foamed metal body, comprising:

mixing a metal powder and a gas-splitting propellant powder to form a mixture;

compacting the mixture at a temperature at which the joining of particles of the metal powder takes place primarily through diffusion and at a pressure which is sufficiently high to hinder the decomposition of the propellant such that the metal particles are permanently bonded to one another and form a gas-tight seal for the gas particles of the propellant;

removing the heat and pressure from the metal body;

heating the metal body to a temperature above the decomposition temperature of the propellant to foam the metal body; and cooling the metal body.

19. The method according to claim 4 wherein said reinforcing components are fibers.

20. The method according to claim 4 wherein said reinforcing components are particles.

21. The method according to claim 19 wherein said fibers are ceramic.

22. The method according to claim 20, wherein said particles are ceramic.

* * * * *